US007849723B2

(12) United States Patent
Cernuschi et al.

(10) Patent No.: US 7,849,723 B2
(45) Date of Patent: Dec. 14, 2010

(54) ROLLING MILL WITH STANDS WITH THREE ADJUSTABLE ROLLS

(75) Inventors: Ettore Cernuschi, Bareggio (IT); Fabrizio Marini, Cinisello Balsamo (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 11/996,930

(22) PCT Filed: Jul. 28, 2006

(86) PCT No.: PCT/EP2006/064779

§ 371 (c)(1),
(2), (4) Date: Jan. 25, 2008

(87) PCT Pub. No.: WO2007/014911

PCT Pub. Date: Feb. 8, 2007

(65) Prior Publication Data

US 2008/0216542 A1 Sep. 11, 2008

(30) Foreign Application Priority Data

Jul. 29, 2005 (IT) ..... MI2005A1480

(51) Int. Cl.
*B21B 13/10* (2006.01)
*B21B 13/12* (2006.01)
*B21B 31/32* (2006.01)

(52) U.S. Cl. ..... 72/224; 72/235; 72/245

(58) Field of Classification Search ..... 72/224, 72/225, 235, 237, 238, 245, 96, 208
See application file for complete search history.

(56) References Cited

U.S. PATENT DOCUMENTS

| | | | | |
|---|---|---|---|---|
| 4,038,855 | A | 8/1977 | Scheib | |
| 5,765,423 | A * | 6/1998 | Cattaneo et al. | 72/224 |
| 6,041,635 | A * | 3/2000 | Cattaneo et al. | 72/235 |
| 6,276,182 | B1 | 8/2001 | Cernuschi et al. | |

FOREIGN PATENT DOCUMENTS

| | | |
|---|---|---|
| DE | 977305 | 11/1965 |
| EP | 0565772 | 10/1992 |
| EP | 0719600 | 7/1996 |
| JP | 06328107 | 11/1994 |
| JP | 07009011 | * 1/1995 |

OTHER PUBLICATIONS

Groover, Fundamentals of Modern Manufacturing, 2002, John Wiley & Sons, Second Edition, pp. 394-395.*
Derwent Database Abstract for JP 07009011A.*
Machine Translation for JP 07009011A, Translated on Feb. 14, 2009.*

* cited by examiner

*Primary Examiner*—Dana Ross
*Assistant Examiner*—Mohammad Yusuf
(74) *Attorney, Agent, or Firm*—Sampson & Associates, P.C.

(57) ABSTRACT

The invention relates to a rolling mill for tubes, in which a series of roll-holder containers (10) is housed in an external structure (2) extended along a rolling axis (L); the containers can slide inside the structure to be extracted therefrom and each one houses at least three rolls (17, 18, 19) controlled by respective driving motors (41, 42, 43). In accordance with the intervention the rolls (17, 18, 19) can be moved inside the containers (10) in a guided way along directions radial in relation to the rolling axis, in order to regulate the distance therefrom.

5 Claims, 3 Drawing Sheets

ROLLING MILL WITH STANDS WITH THREE ADJUSTABLE ROLLS

FIELD OF THE INVENTION

The following invention relates generally to seamless tube rolling operated with a mandrel.

DESCRIPTION OF THE PRIOR ART

For this rolling process it is known to use rolling mills with two-roll stands having an orientation staggered 90° from one to another, or three-roll rolling mills also staggered from one to another, but at an angle of 60°: the present invention relates to this latter type of rolling mill.

In accordance with a currently preferred embodiment, the three rolls of each stand are mounted on respective oscillating arms having an end pivoted to a support container, which can be extracted from the structure of the rolling mill by making it slide along slides parallel to the rolling axis.

One example of this type of rolling mill is described in EP565772, to which reference should be made for further details on the subject.

On the other hand, what should be noted relating to this state of the art, is that the mounting of the rolls on oscillating arms implies numerous drawbacks.

For example, one of these is due to the registration of the pivot following the re-turning of the rolls, of which mention is also made in the patent cited previously.

In fact this operation entails non-negligible practical drawbacks, due to the fact that the insertion of thicknesses in the pivot support requires the removal of the respective arm, with the problems deriving from the weight thereof as well as the dirt that deposits on the pivot during rolling.

Should one not wish to act on the pivot by holding it immobile, it is possible to interpose packings between the seals of the bearings and the coupling beam that constitutes the top part of the lever, but again in this case the operation proves laborious.

Furthermore, in order to be able to extract the arms from the container, it is necessary that the latter is open frontally as in the patent cited above, or radially as in the rolling mill illustrated in U.S. Pat. No. 6,276,182; this entails in any case that the container does not have a very rigid structure, especially in an axial direction.

SUMMARY OF THE INVENTION

The aim of the present invention is to improve this state of the art.

It therefore has the primary aim of providing a rolling mill with stands with three controlled rolls, wherein the position of the latter can be regulated in a simple and effective way also following the variation in diameter thereof caused by periodic re-turning.

The radial regulation of the position of the rolls is also used for rolling diverse products.

A second aim of the invention is that of arranging containers for the housing of the rolls, which are structurally resistant and make it possible to extract the rolls in an easy way for maintenance.

These and other aims of the invention are achieved by a rolling mill the characteristics of which are illustrated in the attached claims which are an integral part of the present description.

BRIEF DESCRIPTION OF THE DRAWINGS

Further characteristics and advantages of the invention will be further evident in view of the detailed description of a preferred though not exclusive embodiment such as illustrated with the aid of the appended drawings wherein.

DESCRIPTION OF THE PREFERRED EMBODIMENT

Figure 1:
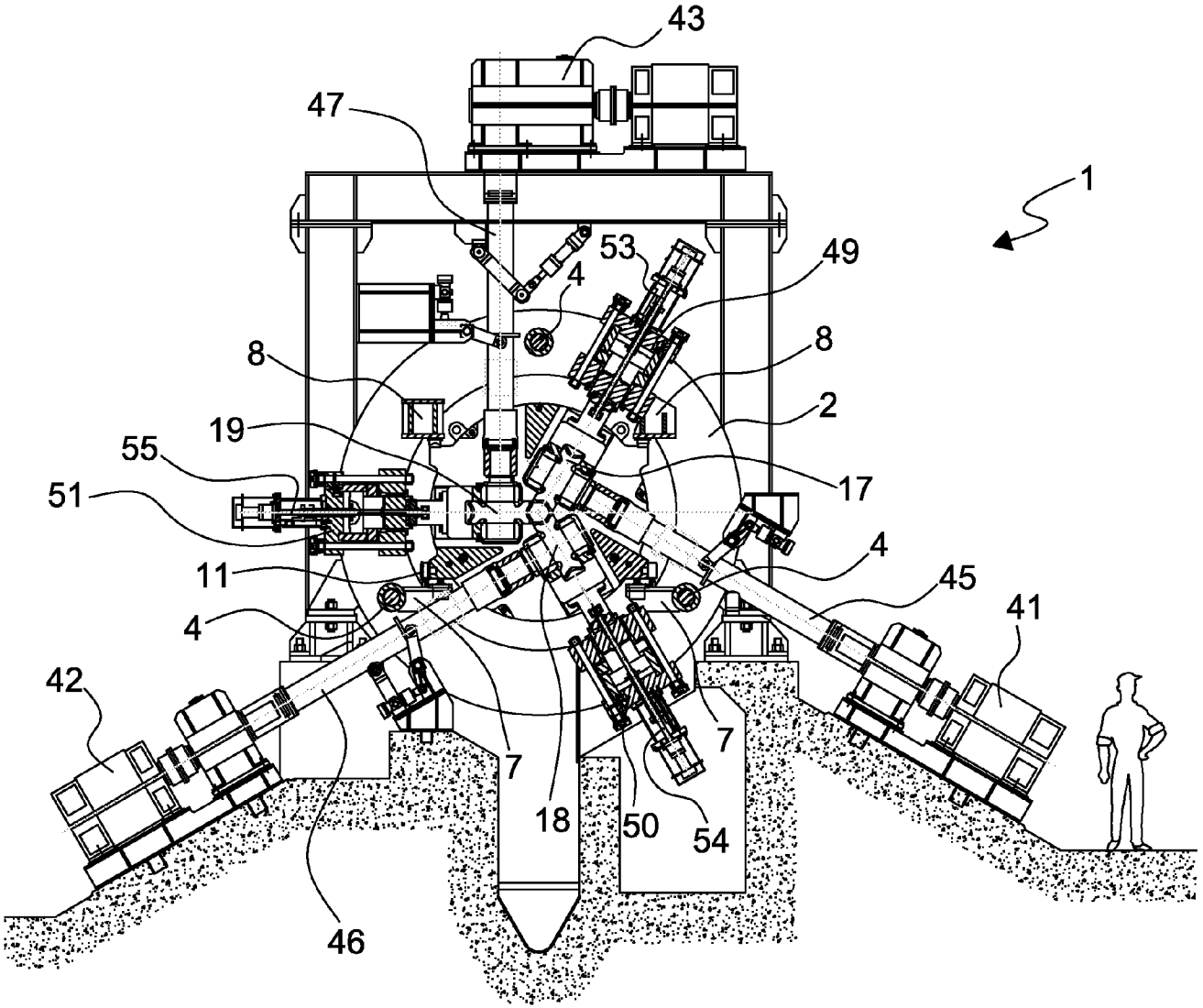
FIG. 1 shows a front view, partially in section, of a rolling stand according to the present invention.

With reference to such drawings, 1 is used to indicate a rolling mill according to the invention, comprising an external structure 2 constituted by a series of circular crown elements 2*a*, 2*b*, 2*c*. . . , 2*n* arranged transversally to the rolling axis L, interconnected with spacers 3 inside which pass the rods 4 tightened at the ends by bolts 5.

Inside the structure 2 of the rolling mill pairs of tracks 7 and 8 are arranged parallel to the longitudinal axis L; in particular, the pair of tracks 7 is located lower than the latter, whilst the other pair 8 is located higher: this because the first pair serves for the sliding of the roll-holder containers 10, whilst the second serves for the blocking thereof.

To this end each container is provided with wheels 11 for the rolling on the lower tracks 7 and here hydraulic jacks (not shown in drawing) are arranged, pushing upward the containers 10 in order to keep them pressed against the upper tracks 8; for this reason, inside the containers contact shoulders 13 are formed against the upper tracks.

Each container 10 houses a triad of rolls 17, 18 and 19 mounted with their seals (bearings) on a respective yoke support 21, 22 and 23; above this is arranged an engagement groove 25, 26 and 27 for the roll balancing system, which will be described better below.

Rotation axes A, B, C of the rolls of each container 10 are arranged at 60° or, preferably, the median planes of the rolls are equidistant by 120° radially in relation to the rolling axis L; said orientation is staggered by 60° with that of the rolls of the adjacent container in the rolling mill.

Furthermore, in accordance with this embodiment of the invention the yoke supports 21, 22 and 23 slide radially in relation to the rolling axis; to this end, in the containers 10 there are slides 29, 30 and 31 that guide the movements of the yoke supports, which can be extracted radially from the containers opened for this purpose at the slides.

Figure 2:
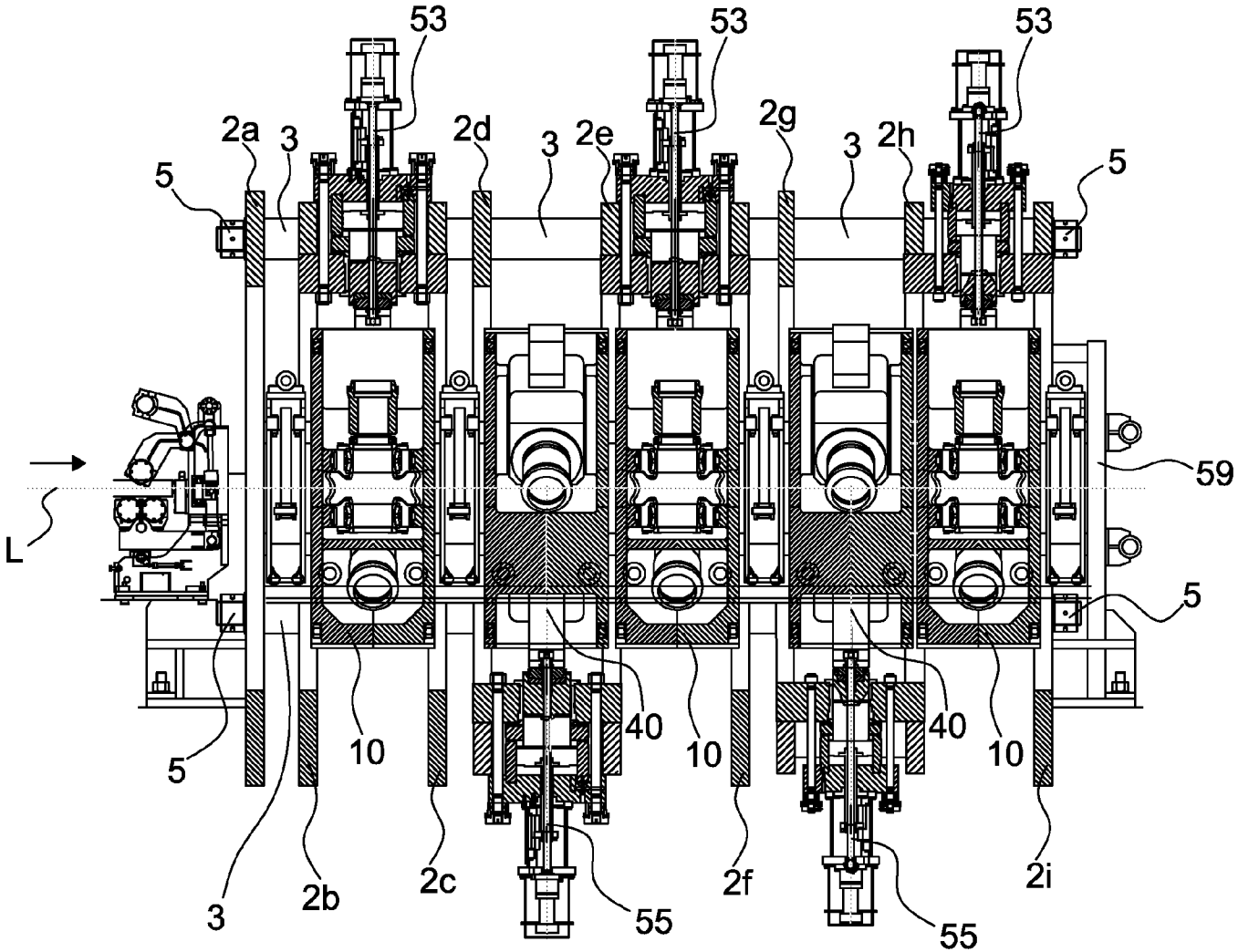
FIG. 2 shows a side view of the rolling stand in FIG. 1.
Figure 3:
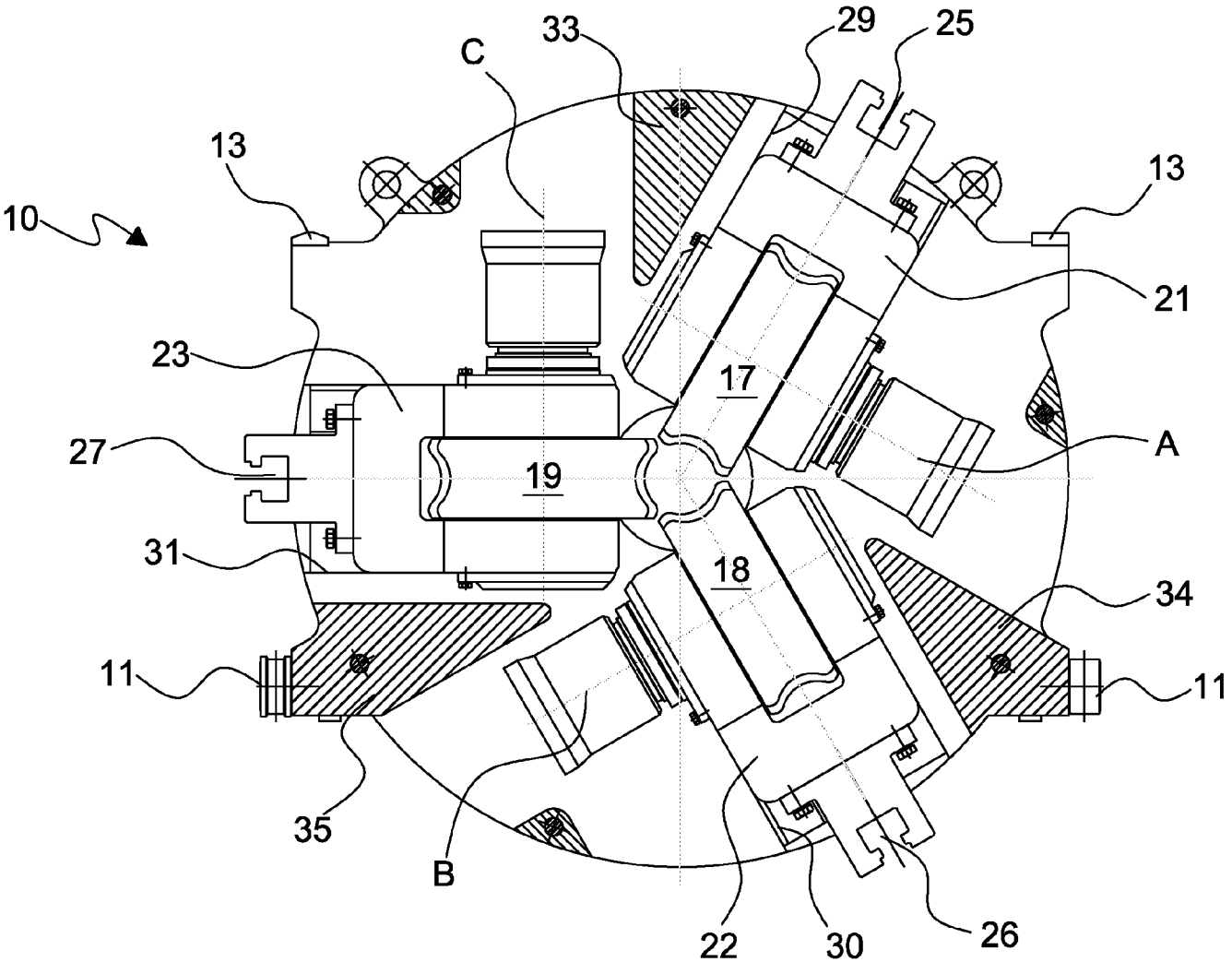
FIG. 3 shows a section of a roll-holder container of the preceding rolling stand.

Furthermore, in the containers 10 blocks 33, 34 and 35 are present to stiffen the structure thereof, which is advantageously formed of two half-shells joined along a median join line 40 (visible in FIG. 2). Such blocks are substantially aligned in the case of even and odd stands, as the containers of two consecutive stands are symmetric in relation to a vertical axis: this fact makes it possible to correctly transmit the forces that act axially along axis L from the containers to the structure 2.

The rolls 17-19 are controlled in a known way by their respective engines 41, 42, 43 and adapters 45, 46, 47, whereas their distance from the rolling axis is regulated by hydraulic capsules 49, 50, 51.

The latter are essentially hydraulic actuators with a fixed part mounted rigidly (with bolts or others) on elements 2*a*, 2*b*, 2*c*, etc. of the external structure of the rolling mill, and a mobile part constituted by a piston that is joined to a balancing rod 53, 54 and 55.

The latter engages in the grooves 25-27 present on the yoke supports 21-23 of the rolls, in order to balance the weight thereof and maintain the position thereof between the rolling of one tube and another; it is opportune to observe that when the containers 10 slide along the tracks 7, the ends of the rods 53, 54, 55 are extracted from the grooves 25, 26 and 27 without hindering the movement of the containers.

It is also useful to observe that the balancing system coaxial with the hydraulic capsules 49, 50 and 51, is unique for each roll 17, 18, 19 unlike the known type of two-roll stands where two balancing systems are present for each roll.

Lastly it is necessary to note that the containers 10 are blocked inside the structure 2 of the rolling mill by a blocking system (not shown in drawings) that pushes them against the first element 2*a* of the external structure 2, furthermore, for roll maintenance and changing operations, the containers are made to slide along the tracks 7 and extracted from a removable bottom 59 of the external structure 2.

In the light of the preceding description it is possible to understand how the rolling stand achieves the purpose of the invention mentioned previously.

In fact, despite maintaining the advantages of three roll rolling, it does not present the drawbacks of the solution with oscillating arms of the state of the art.

In particular, thanks to the possibility of sliding along the slides 29-31 of the supports 21-23, no adjustment is necessary after rolls have been re-turned for the routine maintenance thereof.

In fact the dimensional reduction due to the removal of the material with turning does not entail any geometric variation to be compensated with the addition of thicknesses or other as occurs in oscillating arm rolling mills: to this end it is sufficient to perform the normal adjustment of rolls 17-19 operated by the hydraulic capsules 49, 50 and 51.

It should be further highlighted that the rolls with the relative yoke supports 21-23 can be easily extracted and reintroduced into the containers 10 thanks to the guides 29-31, which in addition to guiding the movements are also a reference for assembly; it should also be pointed out that the containers 10 are advantageously open at the guides 29-31, in order to consent the radial movement of the yoke supports with the rolls, without necessarily having to disassemble the containers.

Along the rolling mill small mandrel-holder stands are provided that serve to prevent contact between mandrel and processing rolls in the rolling mill input and emptying steps. Such small stands are normally of the three opening roll type and are devices in themselves known to those skilled in the art.

Similarly means are provided for releasing the adapters 45, 46 and 47 from the processing rolls 17, 18 and 19 and for supporting and positioning the adapters.

The invention claimed is:

1. Rolling mill of the type operating with mandrel for rolling tubes, comprising an external structure extended along a rolling axis (L), a plurality of containers housed in the external structure and each one containing at least three rolls, actuating means for controlling the rotating rolls, means for regulating the distance of the rolls from the rolling axis (L), balancing systems for balancing the weight of the rolls and maintaining the position of the rolls between the rolling of one tube and another;

wherein the rolls are mounted on respective yoke supports sliding along slides arranged in the containers so as to be movable inside the containers in a guided way along directions radial with respect to the rolling axis, in order to adjust the distance therefrom, wherein in that the rolls and the respective yoke supports are extractable radially from the containers through respective openings at the slides wherein said means for regulating the distance of the rolls from the rolling axis (L) comprise a single hydraulic capsule for each roll;

wherein there is provided a single balancing system for each roll and wherein each balancing system is coaxial with the respective hydraulic capsule, said balancing system and said respective hydraulic capsule being operated along an axis tranverse to an axis of rotation of the respective roll.

2. Rolling mill according to claim 1, wherein the balancing systems comprise a balancing rod adapted to engage in a groove present on the yoke supports of the rolls.

3. Rolling mill according to claim 2, wherein the containers are suitable for sliding along the rolling axis (L) to be extracted from the external structure and wherein the grooves present on the yoke supports are oriented according to this sliding, whereby the balancing rods disengage from the grooves when the containers are extracted from the structure.

4. Rolling mill according to claim 3, wherein the containers comprise two half shells joined along a median line and stiffened by spacer blocks extended between the half-shells.

5. Rolling mill according to claim 4, wherein the blocks of adjacent containers in the structure are substantially aligned, so as to correctly transmit the rolling forces that act along the axis L, from the containers to the external structure of the rolling mill.

* * * * *